United States Patent [19]

Morita et al.

[11] 3,935,301

[45] Jan. 27, 1976

[54] PROCESS FOR PRODUCING CARBON FIBERS FROM ORGANIC FIBROUS MATERIAL

[75] Inventors: Ken-ichi Morita; Yoshiro Kinoshita; Shigetora Kashio, all of Otsu, Japan

[73] Assignee: Toray Industries, Inc., Tokyo, Japan

[22] Filed: May 29, 1973

[21] Appl. No.: 364,752

[30] Foreign Application Priority Data

June 1, 1972 Japan ..... 47-53827
Aug. 7, 1972 Japan ..... 47-78410

[52] U.S. Cl. ..... 423/447; 264/29; 264/DIG. 19
[51] Int. Cl.[2] ..... B29C 25/00
[58] Field of Search ..... 264/29, DIG. 19; 423/447

[56] References Cited

UNITED STATES PATENTS

| | | | |
|---|---|---|---|
| 3,011,981 | 12/1961 | Soltes | 423/447 |
| 3,508,874 | 4/1970 | Rulison | 423/447 |
| 3,528,774 | 9/1970 | Ezekiel et al. | 423/447 |
| 3,552,923 | 1/1971 | Carpenter et al. | 423/447 |
| 3,572,286 | 3/1971 | Forney | 264/DIG. 19 |
| 3,634,035 | 1/1972 | Stuetz et al. | 423/447 |
| 3,635,675 | 1/1972 | Ezekiel | 423/447 |
| 3,656,910 | 4/1972 | Ferment | 423/447 |
| 3,689,220 | 9/1972 | Smudski | 423/447 |

FOREIGN PATENTS OR APPLICATIONS

| | | | |
|---|---|---|---|
| 1,580,443 | 9/1969 | France | 423/447 |
| 2,023,918 | 11/1970 | Germany | 423/447 |

*Primary Examiner*—Jay H. Woo

[57] ABSTRACT

Organic fibrous material is changed to heat-stabilized material by heating in an atmosphere, and then the heat-stabilized material is carbonized in a carbonizing furnace at a temperature of from about 800°C to 1600°C.

When temperature at any given point in the furnace is plotted on a vertical axis and the particular location along the length of the carbonizing furnace is plotted on a horizontal axis, the slope of the resulting temperature profile above 800°C either remains constant or decreases until the maximum temperature in the furnace is reached.

14 Claims, 4 Drawing Figures

PROCESS FOR PRODUCING CARBON FIBERS FROM ORGANIC FIBROUS MATERIAL

BACKGROUND OF THE INVENTION

This invention relates to a process of producing carbon fibers from organic fibrous material, and more particularly relates to a process for producing carbon fibers having high strength and high Young's modulus at high yarn running speed.

DESCRIPTION OF THE PRIOR ART

Heretofore, many procedures have been proposed for the conversion of organic polymeric fibrous material to carbon fibers.

Such conversion has generally been accomplished by heating the organic fibrous material in an active atmosphere at a moderate temperature in order to produce a heat-stabilized material, and then by carbonizing it in an inert atmosphere at an elevated temperature.

The method of conversion of fibrous material to a heat-stabilized structure in the prior art comprises preoxidation treatment of the fibrous material in air or in an oxygen-containing atmosphere, prenitrozation treatment in nitrogen monoxide, or presulfurization treatment in sulfur dioxide. The heat-treatment stages yield a stabilized fibrous material which may be carbonized or graphitized in an inert atmosphere to produce carbon fibers or graphite fibers.

The carbon fibers are formed by heating the heat-stabilized fibrous material at a temperature from 200°C to 1600°C or above in an inert atmosphere.

During the carbonization or graphitization process, the heat-stabilized material is usually passed through a long carbonizing furnace under tension.

It has long been desired to pass the stabilized fibrous material at high running speed through a carbonizing furnace in order to produce carbon fibers at low cost.

An object of this invention is to provide an efficient process of producing carbon fibers having both high strength and high Young's modulus.

Another object of this invention is to provide an industrially feasible process capable of shortening the time required for producing carbon fibers and the like, as compared with prior processes.

Other objects and advantages of this invention will become apparent hereinafter.

SUMMARY OF THE INVENTION

The above mentioned and other objects of this invention are accomplished by:

A. preparing a heat-stabilized product by heating organic fibrous material in an active atmosphere, and B. heating the heat-stabilized product in a carbonizing furnace at a temperature of from about 800°C to 1600°C, and controlling such heating to provide a profile above 800°C such that, when the temperature at any given point along the path of advancement of the product in the furnace is plotted on a vertical axis and locations along the length of the carbonizing furnace are plotted on the horizontal axis, the slope of the resulting plot either remains constant or decreases until maximum temperature is reached.

It is important that, when temperature is plotted against location along the length of the furnace, when temperature profile is divided midway along the length of said furnace by a vertical axis, the area under the plot on the outlet side of the furnace is greater than the area under the plot on the inlet side of said furnace.

It is desirable that, during the progress of the material through the furnace, the average heating rate should be smaller than the average cooling rate.

Moreover, it is important that the maximum temperature exists somewhat along the outlet side of the center of the furnace.

DESCRIPTION OF A PREFERRED EMBODIMENT

Figure 1:
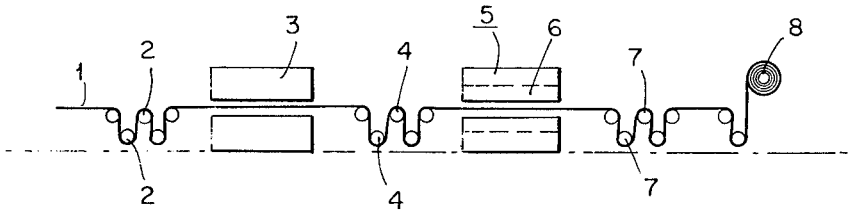
FIG. 1 is a diagram showing a furnace arrangement in which the present invention is useful.

In FIG. 1, an organic fibrous material 1 is conducted by rollers 2, into a heating furnace 3 in which the fibrous material 1 is heated so that it is stabilized in air, and then the resulting stabilized fibrous material is passed through a carbonizing furnace 5 having a graphite-resistance tube 6 which is provided with suitable electrodes, in which the stabilized fibrous material is carbonized. The resulting carbon fiber is wound up on a winding roller 8.

An important feature of this invention resides in the temperature profile in the carbonizing furnace.

The necessary conditions for the temperature profile during the carbonization procedure, in order to obtain a carbon fiber having the optimum mechanical properties at high line speed are:

I. the carbonizing furnace should be at a temperature of from about 800°C to 1600°C;

II. When furnace temperature is plotted on a vertical axis in a graphical representation, and particular points along the length of the furnace are plotted along a horizontal axis, the temperature profile above 800°C has a slope that either remains constant or decreases until the maximum furnace temperature is reached;

III. the heating rates between 800°C and 1050°C are greater, and preferably from about 2 to 15 times greater than those above 1050°C.

IV. When the temperature profile is divided vertically midway along the length of said furnace the area under the plot at the outlet side of the furnace is about 1.1 to 2 times, preferably about 1.2 to 1.8 times larger than that under the plot at the inlet side of said furnace;

V. the average cooling rate is about 2 to 50 times, preferably about 3 to 30 times, larger than that of the heating rate in the furnace.

As referred to herein, the cooling rate is indicated by the slope of an inclined line running from the top of the temperature profile, along the length of the furnace until the temperature of the outlet of the furnace is reached. The heating rate is measured by the slope of an inclined line of the temperature profile, running from the entrance along the length of said furnace until the maximum temperature of the furnace is reached.

In this invention the fibrous material is generally heated to a maximum temperature of from about 1000°C to 1600°C, preferably about 1150°C to 1500°C, in an inert atmosphere.

The carbonization procedure may be conducted in a non-oxidizing atmosphere. Suitable inert atmospheres include nitrogen, argon, helium, hydrogen, halogens, hydrogen chloride and atmospheres containing these gases, for example.

In preferred embodiments of this invention, the starting organic fibrous materials include polyacrylonitriles, polyamides, polybenzimidazols, polyvinyl alcohols, cellulose and pitch.

In a preferred embodiment of this invention, the organic fibrous material is continuously heated at a temperature of from about 200°C to 320°C for about 5 to 200 minutes in air, at a temperature of from about 240°C to 350°C for about 5 to 40 minutes in nitrogen monoxide, or at a temperature of about 250°C to 350°C for about 5 to 40 minutes in sulfur dioxide.

The carbonization procedure is preferably conducted at a yarn speed of about 0.5 to 65 meters per minute.

In accordance with this invention, the carbonization step may be conducted in any apparatus capable of serving as one or more carbonizing furnaces.

In any case, the total length of the furnace is preferably from about 1 meter to 15 meters.

The following examples are given as specific illustrations of this invention. It should be understood, however, that the invention is not limited to the specific details set forth therein.

EXAMPLES 1 to 8

Polyacrylonitrile fibers were used which contained more than about 99 percent by weight of polyacrylonitrile and had a dry tenacity of 43 grams per denier and an elasticity of 110 grams per denier. These fibers were oxidized in an atmosphere of air, and then precarbonized at a heating rate of 2500°C per minute up to 800°C.

Figure 2:
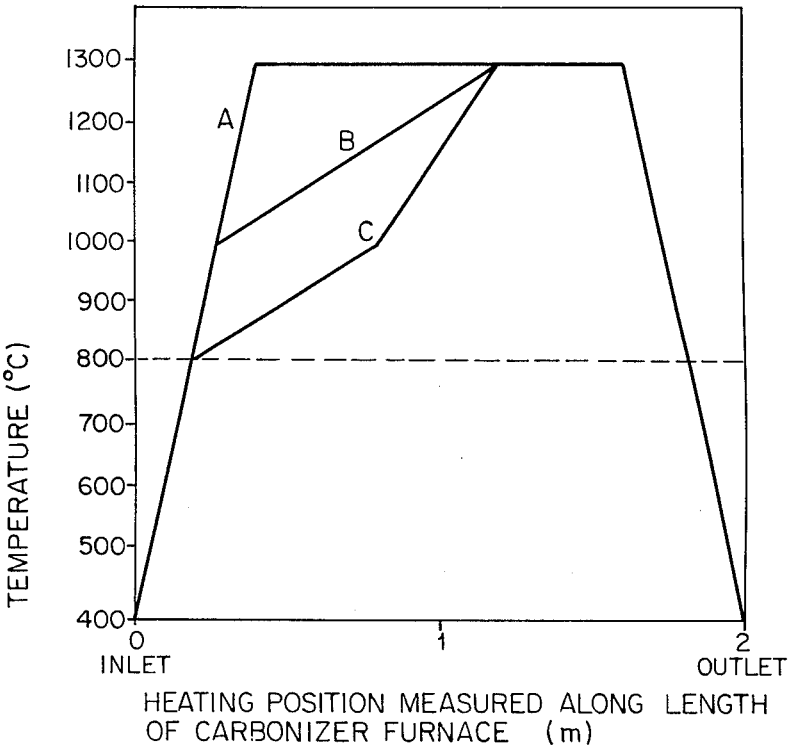
FIGS. 2, 3 and 4 are drawings showing the relationship between temperature and position along the length of the carbonizing furnace. Plot "B" of FIG. 2 represents a heating program in accordance with this invention while plots "A" and "C" and plot "D" of FIG. 3 are outside the scope of this invention and are comparative examples. Also, plot "G" of FIG. 4 illustrates a useful embodiment in accordance with this invention.
Figure 3:
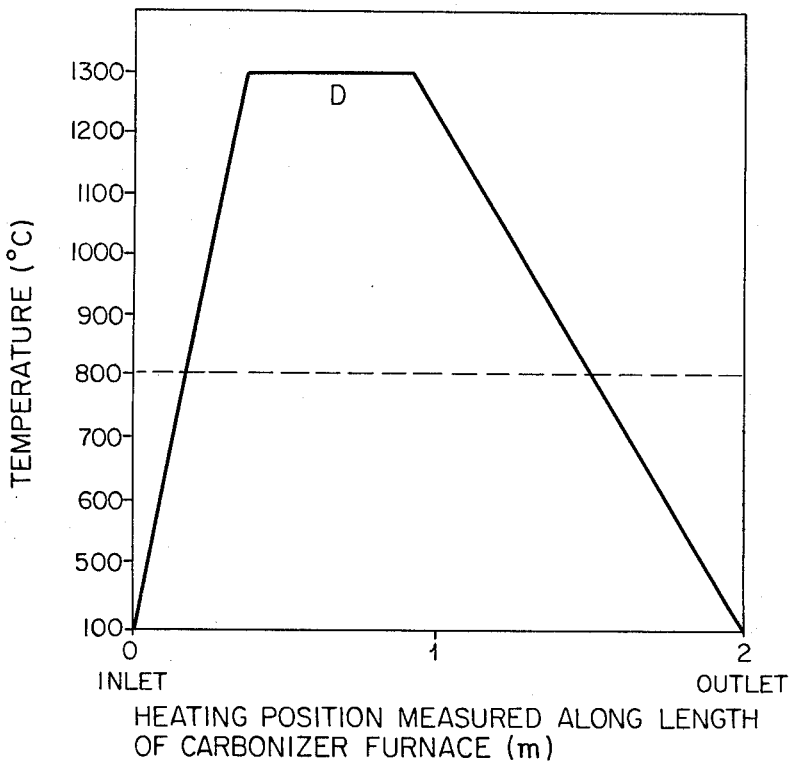

The subsequent stage of carbonization was conducted up to 1300°C in an atmosphere of nitrogen using a furnace two meters long which had temperature profiles as shown in FIG. 2 (A, B and C) and FIG. 3 (D).

The carbonizations were carried out at 6 meters per minute in Examples I to IV and 8 meters per minute in Examples V to VIII.

The mechanical properties of the resulting carbon fibers are shown in Table 1.

It is apparent that the mechanical properties of the carbon fibers which are prepared using temperature profile B are better than the others.

TABLE I

| Example | Yarn speed (m/min) | Furnace temperature profile | Mechanical properties of the resulting carbon fibers: tensile strength (kg/mm²) | Young's modulus (tons/mm²) |
|---|---|---|---|---|
| I | 6 | A | 190 | 20 |
| II | 6 | B | 350 | 26 |
| III | 6 | C | 250 | 23 |
| IV | 6 | D | 180 | 18 |
| V | 8 | A | 120 | 15 |
| VI | 8 | B | 310 | 24 |
| VII | 8 | C | 220 | 20 |
| VIII | 8 | D | 130 | 17 |

EXAMPLE 9

Figure 4:
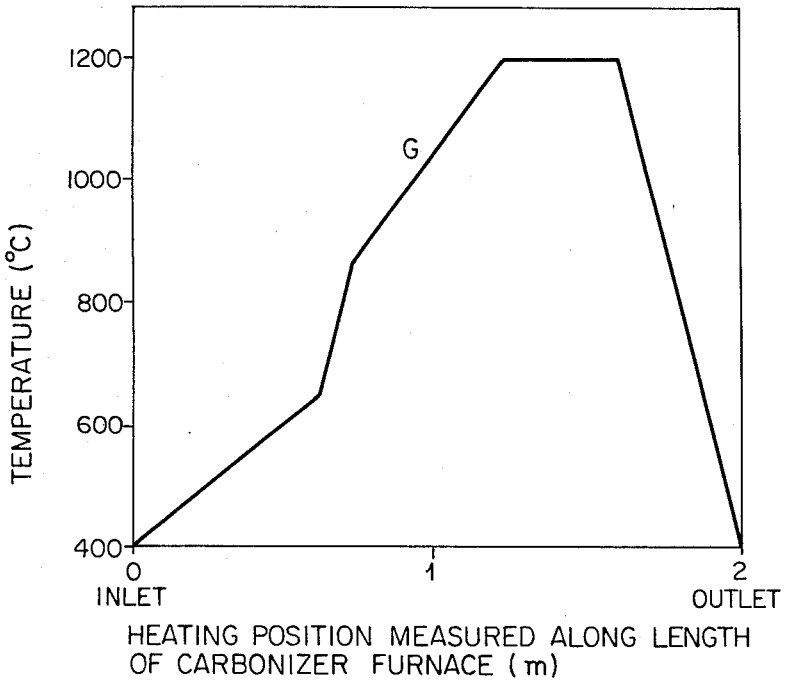

Polyacrylonitrile fibers which contained more than about 99 percent by weight of polyacrylonitrile and had a dry tenacity of 4.3 grams per denier and an elasticity of 110 grams per denier were oxidized in an atmosphere of air and carbonized at a line speed of 5 meters per minute using a carbonizing furnace two meters long which had the temperature profile G in FIG. 4. The mechanical properties of the resulting carbon fibers are shown in Table II.

TABLE II

| Example | Yarn speed (m/min) | Temperature profile in furnaces | Mechanical properties of the resulting carbon fibers: Tensile strength (kg/mm²) | Young's Modulus (tons/mm²) |
|---|---|---|---|---|
| XI | 5 | G | 310 | 24 |

We claim:

1. In a process for producing a carbon fiber from an organic fibrous material which contains carbon in a form which is subject to heat stabilization in an active atmosphere and which carbon is operative to form strong carbon fibers in a non-oxidizing atmosphere, the steps which comprise:

A. preparing a heat-stabilized organic fibrous material by heating said organic fibrous material in an active atmosphere, and B. conduction said fibrous material under tension at a speed of about 0.5 – 65 meters per minute and heating said heat-stabilized fibrous material in a carbonizing furnace maintained at a temperature of from about 800° C to 1600° C over a total length from about 1 – 15 meters, B-1. controlling said heating in said furnace to provide a profile of such character that when temperature is plotted on a vertical axis and locations along the length of the carbonizing furnace are plotted on the horizontal axis, the temperature profile above 800° C has a slope which either remains constant or decreases until the maximum temperature in said furnace is reached, B-2. said heating being further characterized by the fact that, when said temperature profile is divided vertically midway along the length of said furnace to form halves representing the inlet portion and the outlet portion of said furnace, the area under the plot corresponding to the outlet portion of said furnace is greater than that representing the inlet portion of said furnace, and wherein B-3. the average cooling rate in said furnace is greater than the average heating rate, and wherein B-4. the maximum furnace temperature exists at the aforementioned outlet portion of said furnace.

2. A process according to claim 1 wherein said organic fibrous material is a polyacrylonitrile fiber.

3. A process according to claim 1 wherein said organic fibrous material is selected from the group consisting of polyamide, polybenzimidazol, polyvinyl alcohol, cellulosic fibrous material and pitch.

4. A process according to claim 1 wherein the active atmosphere is air in which said organic fibrous material is heated at a temperature of from about 200°C to 320°C.

5. A process according to claim 1 wherein the active atmosphere is nitrogen monoxide in which said organic fibrous material is heated at a temperature of from about 240°C to 350°C.

6. A process according to claim 1 wherein the active atmosphere is sulfur dioxide in which said organic fibrous material is heated at a temperature of from about 250°C to 350°C.

7. A process according to claim 1 wherein the maximum temperature is between about 1000°C and 1600°C.

8. A process according to claim 1 wherein the area under said temperature profile plot corresponding to the outlet half of the furnace is about 1.2 to 1.5 times greater than that under the plot corresponding to the inlet half of the furnace.

9. A process according to claim 1 wherein the yarn speed in said furnace is from about 0.5 meters per minute to about 65 meters per minute.

10. A process according to claim 1 wherein the average cooling rate is about 3 to 30 times greater than the average heating rate.

11. A process according to claim 1 wherein the heating rate between 800°C and 1050°C is about 2 to 15 times greater than that above 1050°C.

12. A process according to claim 1 wherein the average heating rate between 800°C and 1050°C is greater than that at above 1050°C.

13. A process according to claim 1 wherein the length of said carbonizing furnace is from about 1 meter to 15 meters.

14. A process according to claim 1 wherein the maximum temperature is not reached in the inlet half of said furnace but is first reached only in the outlet half of said furnace.

* * * * *